US005584254A

United States Patent [19]

Williams

[11] Patent Number: 5,584,254

[45] Date of Patent: Dec. 17, 1996

[54] COLLAPSIBLE WORK BENCH APPARATUS

[76] Inventor: Willis R. Williams, 767 S. Fielder, Arlington, Tex. 76013

[21] Appl. No.: 245,286

[22] Filed: May 16, 1994

[51] Int. Cl.[6] ..... A47B 3/02

[52] U.S. Cl. ..... 108/118; 108/29; 269/100; 269/900

[58] Field of Search ..... 108/118, 115, 108/128, 131, 64, 29, 30, 50, 69, 65; 248/188.9; 269/99, 100, 101, 900

[56] References Cited

U.S. PATENT DOCUMENTS

| | | | |
|---|---|---|---|
| 559,743 | 5/1896 | Ormsby . | |
| 1,329,257 | 1/1920 | Terry | 108/123 X |
| 2,032,593 | 3/1936 | Rice | 108/131 X |
| 2,423,659 | 7/1947 | Rabe | 248/188.9 |
| 2,584,744 | 2/1952 | Schwartz | 108/29 X |
| 2,587,010 | 2/1952 | Thompson . | |
| 2,618,525 | 11/1952 | Panzer . | |
| 2,699,977 | 1/1955 | Breslow | 108/64 X |
| 2,716,582 | 8/1955 | Rosenfeld | 108/118 X |
| 3,704,674 | 12/1972 | Johnson | 108/118 |
| 3,999,397 | 12/1976 | Albery | 108/64 X |
| 4,061,305 | 12/1977 | Beckenkamp | 108/118 X |
| 4,170,345 | 10/1979 | Townsend | 269/88 |
| 4,186,784 | 2/1980 | Stone | 108/90 X |
| 4,262,606 | 4/1981 | Hodson | 108/118 X |
| 4,445,678 | 5/1984 | George | 269/88 |
| 4,677,920 | 7/1987 | Eccardt | 108/64 X |
| 4,733,704 | 3/1988 | Wolff | 144/286 |
| 4,793,265 | 12/1988 | Morris | 108/118 |
| 4,794,687 | 1/1989 | Peters et al. | 29/559 |
| 4,819,922 | 4/1989 | Boike | 269/100 X |
| 5,052,308 | 10/1991 | Brown | 108/118 |
| 5,259,601 | 11/1993 | Vass | 269/100 X |
| 5,320,150 | 6/1994 | Everts et al. | 144/287 |
| 5,405,123 | 4/1995 | Mielenz | 269/99 X |

FOREIGN PATENT DOCUMENTS

| | | | |
|---|---|---|---|
| 0224653 | 8/1986 | European Pat. Off. . | |
| 2559657 | 8/1985 | France . | |
| 1554480 | 1/1970 | Germany . | |
| 3538529 | 5/1987 | Germany . | |
| 8611721 | 7/1987 | Germany . | |
| 673565 | 3/1990 | Switzerland | 108/118 |
| 2186790 | 8/1987 | United Kingdom | 108/118 |
| 2231833 | 11/1990 | United Kingdom . | |

*Primary Examiner*—Peter M. Cuomo
*Assistant Examiner*—Janet M. Wilkens

[57] ABSTRACT

A collapsible work bench apparatus (10) for use with clamps and conventional power tools and, including two pairs of support legs (20)(21)(22)(23) pivotally connected to two pairs of strut arms (30)(31)(32)(33); wherein each pair of strut arms is provided with mirror image table top portions (40)(41), including an apertured support surface (42) provided with inboard (45) and outboard (44) (44') channels that may be joined together to other work bench apparatus (10) in both end-to-end and side-to-side fashion by a locking clip (60) and a locking bar (70).

28 Claims, 4 Drawing Sheets

COLLAPSIBLE WORK BENCH APPARATUS

TECHNICAL FIELD

This present invention relates to the field of foldable work support surfaces in general, and in particular, to a collapsible work bench apparatus having self-supporting work surfaces which cooperate with one another when the apparatus is deployed in its operative disposition.

BACKGROUND ART

As can be seen by reference to the following U.S. Pat. Nos. 5,052,308; 2,618,525; 2,587,010; and 559,743; the prior art is replete with myriad and diverse collapsible table and work bench constructions.

While all of the aforementioned prior art constructions are more than adequate for the basic purpose and function for which they have been specifically designed, these patented arrangements are still uniformly deficient with regard to their adaptability for use with a variety of conventional workshop hand tools and bench top power tools and accessories.

As both professional craftsman and weekend handymen are all to well aware, most of their tasks and chores require a sturdy, strong and dependable work surface which is both compact and portable to facilitate transport between work sites and for the purposes of storage.

As a consequence of the foregoing situation, there has existed a longstanding need for a new type of collapsible work bench apparatus that will fulfill all of the needs of both the professional and amateur craftsman alike, and the provision of such a construction is a stated objective of the present invention.

DISCLOSURE OF THE INVENTION

Briefly stated, the collapsible work bench apparatus that forms the basis of the present invention comprises in general two pairs of support legs pivotally joined together; wherein, each pair of support legs is provided with a pair of support struts which are pivotally joined to one of the pairs of support legs and connected to one another by a portion of the work bench work surface whereas the entire apparatus is portable.

Each portion of the work bench work surface is further provided with a central apertured panel which is flanked on both ends by at least one track member.

As will be explained in greater detail further on in the specification, the collapsible work bench apparatus of this invention further includes at least one locking clip element for joining the portions of the work bench surface together in their operative mode of disposition as well as in a side to side orientation with another work bench apparatus, and identical at least one locking bar for joining two identical work bench apparatus together in a end-to-end orientation.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
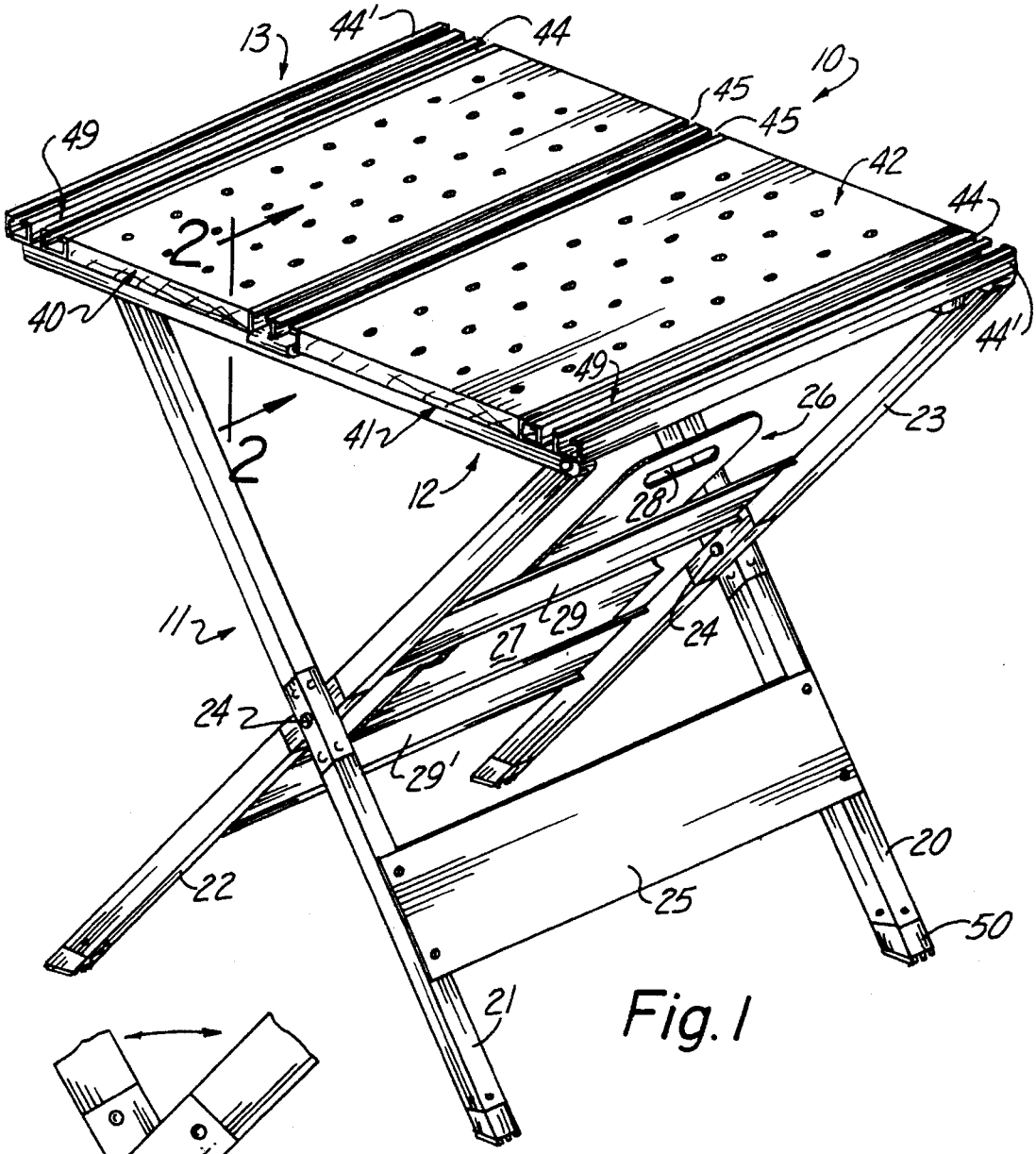
FIG. 1 is a perspective view of the work bench apparatus that forms the basis of the present invention deployed in its operative mode of disposition.

As can be seen by reference to the drawings, and in particular to FIG. 1, the collapsible work bench apparatus that forms the basis of the present invention is designated generally by the reference numeral (10).

The apparatus (10) comprises in general a support leg assembly (11) a strut assembly (12) and a work support assembly (13). These assemblies will now be described in seriatim fashion.

Figure 3:
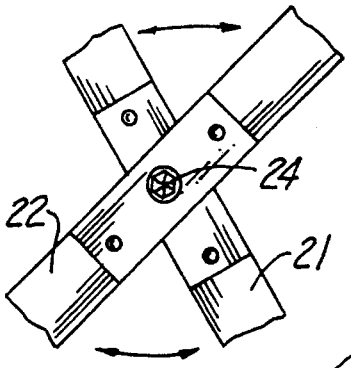
FIG. 3 is an isolated side view of the pivotal engagement between the support legs.

As shown in FIGS. 1 and 3, the support leg assembly (11) comprises two pairs of support legs (20) (21) and (22) (23); wherein, the first outer pair of support legs (20) (21) is pivotally connected to the second inner pair of support legs (22) (23) proximate their respective midpoints by pivot bolts (24) in a well-recognized manner, and wherein, the first pair of support legs (20)(21) are provided with a brace leg (25) at a location below the pivot bolts, and the second pair of support legs (22)(23) are provided with an enlarged contoured brace element (26) which will be described presently.

Figure 7:
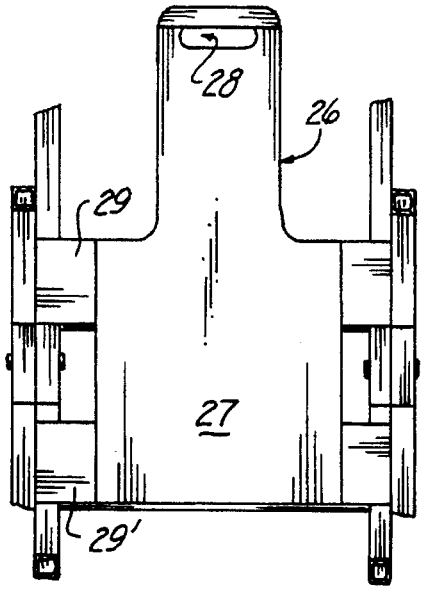
FIG. 7 is a detailed view of the combined handle and brace element of the apparatus.
Figure 9:
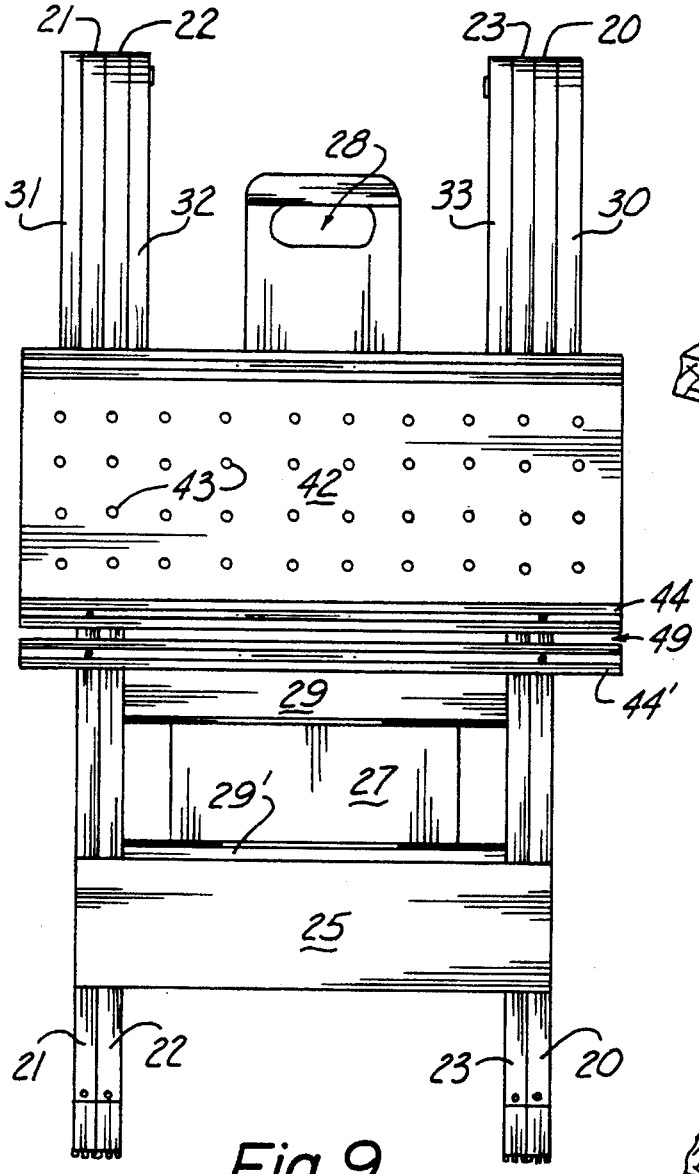
FIG. 9 is a side elevation view of the work bench apparatus.

As can best be seen by reference to FIGS. 1, 7 and 9, the contoured brace element (26) comprises an elongated central body portion (27) having an handle aperture (28) formed therein and a pair of brace arms (29) (29') which are rigidly secured to the contoured brace element and connected to the support legs (22)(23) at locations both above and below the position of the pivot bolts (24).

Figure 13:
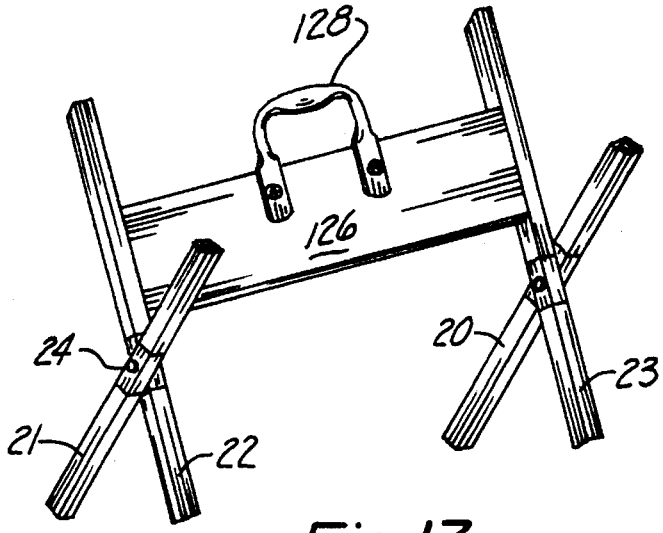
FIG. 13 is an isolated detail view of an alternate handle and brace arrangement.

In an alternate version of the preferred embodiment depicted in FIG. 13, the contoured brace element (26) is replaced by a single elongated rectangular brace member (126) which is securely affixed intermediate the second pair of support legs (22)(23) at a point disposed proximate to, but above the location of the pivot bolts (24). In addition, the brace member (126) is further provided with a rigid handle element (128).

Turning now to FIGS. 1, 4, 5 and 6, it can be seen that the bottom of each one of the support legs is provided with a foot member (50), including an angled rubberized bearing pad (51) having two distinct ribbed bearing surfaces (52) and (53); wherein, one bearing surface (52) is in contact with the floor when the apparatus is deployed in its operative disposition and the other bearing surface (53) is in contact with the floor when the apparatus is deployed in its stored disposition.

As shown in FIGS. 5, 6, 8 and 9, the strut assembly (12) comprises a first pair of elongated outer strut arms (30)(31) pivotally secured on one end to the upper ends respectively of the first outer pair of support legs (20) and (21), and a second pair of elongated inner strut arms (32)(33) pivotally secured on one end to the upper ends respectively of the second inner pair of support legs (22) (23) in a well-recognized manner.

Still referring to FIGS. 5, 6, 8 and 9, it can be seen that the work support assembly (13) comprises two mirror image table top portions (40)(41), wherein, each table top portion (40) comprises an enlarged generally rectangular rigid support surface (42) provided with a plurality of spaced apertures (43) arranged in parallel rows, and wherein each support surface (42) is secured to the outboard or free ends respectively of the two pairs of strut arms (30)(31) and (32)(33).

Figure 11:
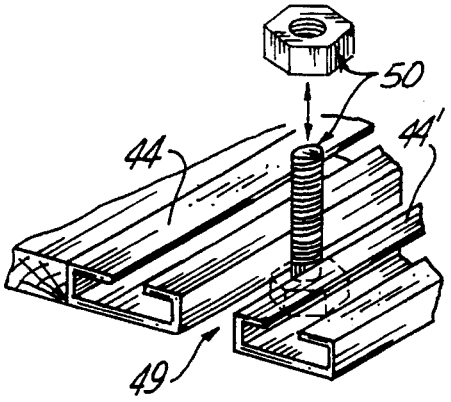
FIG. 11 is an isolated detail view of the means by which power tools may be mounted on the apparatus.
Figure 10:
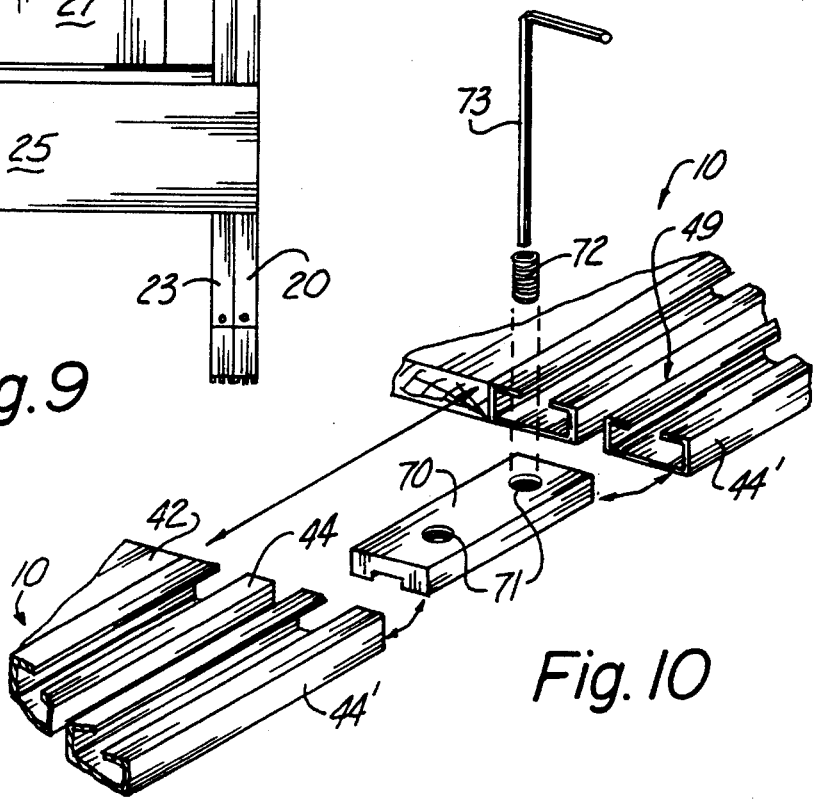
FIG. 10 is an isolated perspective view of the end-to-end engagement of two identical work bench apparatus.

In addition, as shown in FIGS. 1, 10 and 11, each support surface (42) is provided with a track system comprised of a pair of track channels (44) (44') separated by a gap (49) and disposed on the outboard edge of the support surface (42) and a single track channel (45) disposed on the inboard edge of the support surface (42). In this manner, when the apparatus (10) is deployed in its operative mode as depicted in FIG. 1, the work surface assembly (13) will have a pair of spaced track channels (44) (44') formed on both sides, and two single track channels (45)(45) disposed in an abutting relationship along its midpoint.

It should also be noted at this juncture, that the track system and the apertured support surfaces are dimensioned and designed to receive diverse accessories and clamping systems for the purpose of securing work pieces to the support surfaces and/or mounting hand tools and power tools thereon as will be explained in greater detail further on in the specification.

Figure 8:
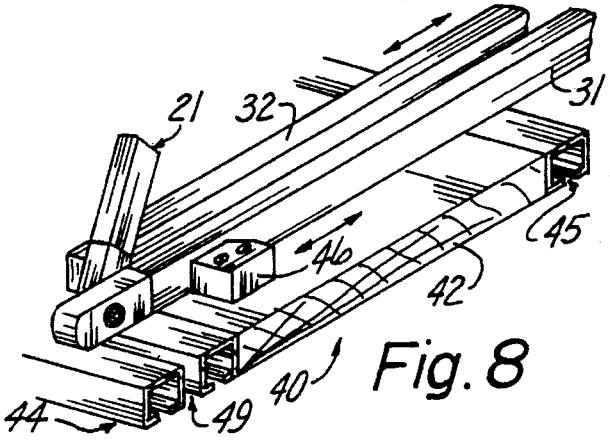
FIG. 8 is an isolated perspective view of the cooperation of the sheer block and the strut member.

As can best be seen by reference to FIG. 8, the bottom portion of each of the support surfaces (42) are provided with shear blocks (46) which engage the strut arms to align the support surfaces (42) and prevent them from a transverse shear condition during operations.

Figure 2:
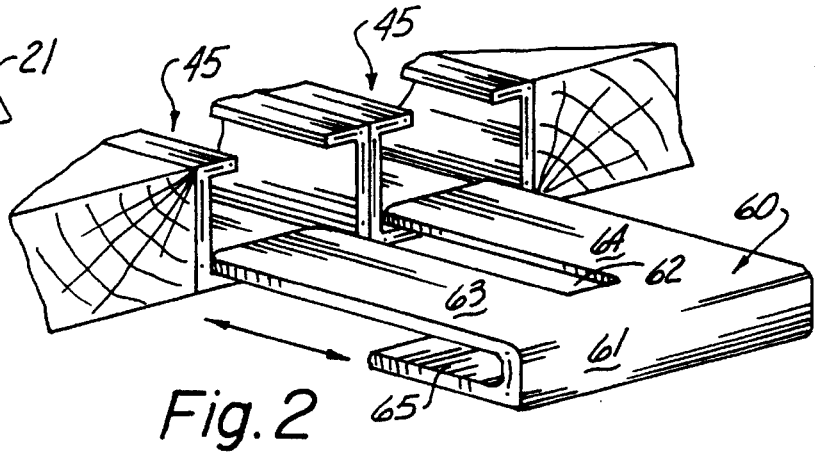
FIG. 2 is an isolated perspective view of the engagement of the locking clip with the work bench work surface.
Figure 5:
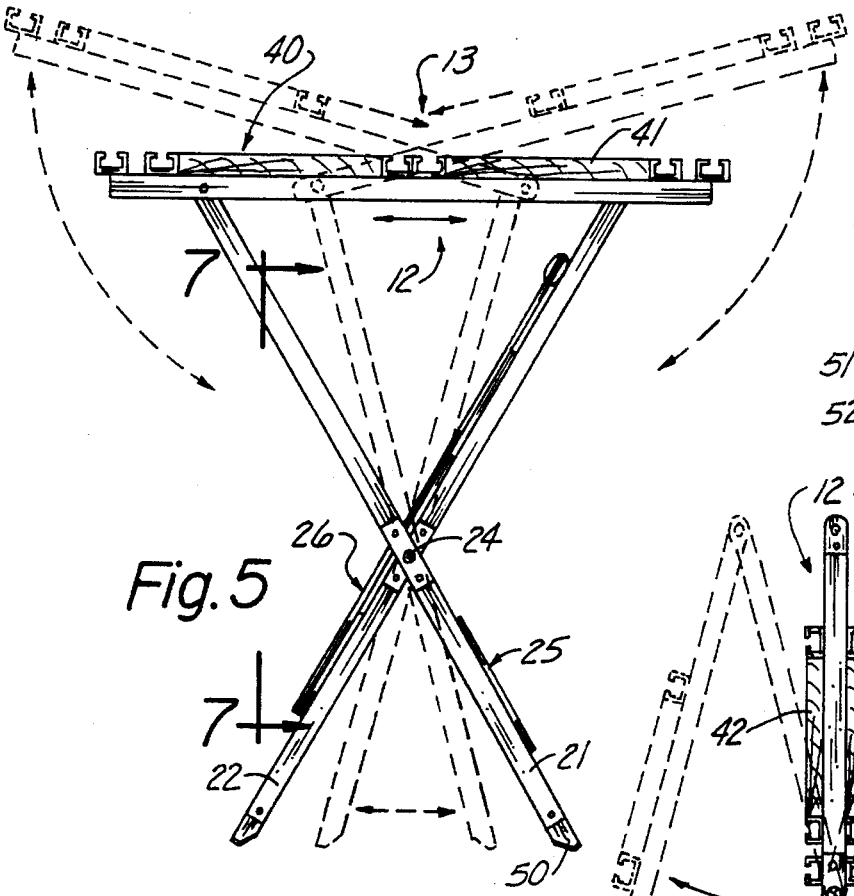
FIG. 5 is a side elevation view of the movements employed to deploy the apparatus in its operative disposition.
Figure 4:
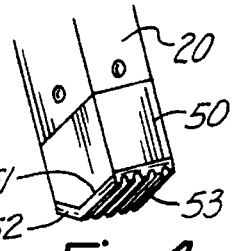
FIG. 4 is an isolated perspective view of the foot construction for each support leg.
Figure 6:
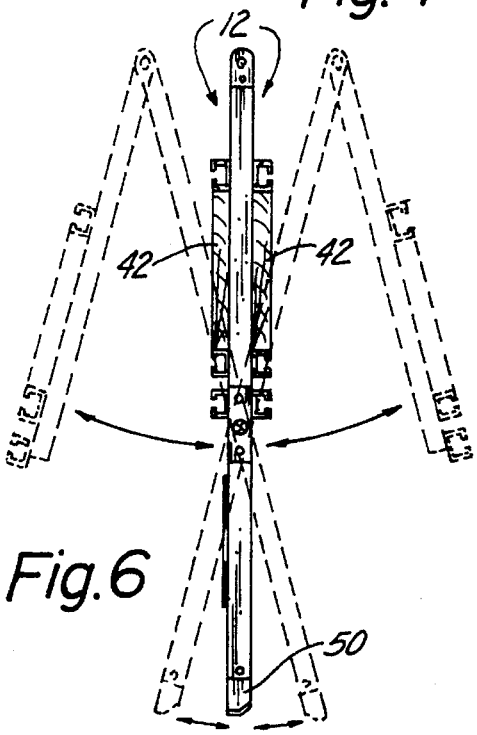
FIG. 6 is a side elevation view of the movements employed to deploy the apparatus in its collapsed disposition.

In addition as shown in FIG. 2, the apparatus (10) is also provided with a locking clip designated generally as (60) for securing the two support surfaces (42) in their operative mode of disposition, wherein the locking clip (60) captively engages the center track channels (45) and maintains them in their abutting relationship.

The locking clip (60) comprises a generally J-shaped clip member (61) having an elongated slot (62) which forms two arms (63)(64) dimensioned to be received within the openings of the abutting channels (45), wherein the slot (62) is dimensioned to receive the abutting walls of the channels (45) and the foot (65) of the clip member (61) extends across the bottom of the abutting track channels (45).

It should further be noted that while the locking clip (60) depicted in FIG. 2 is used to join the support surfaces (42) of a single apparatus (10) together, the locking clip (60) may also be employed to join two identical apparatus (10) together in a side-by-side fashion by inserting the locking clip (60) into the outboard tracks of two abutting outboard track channels (44') on the respective apparatus (10).

Turning now to FIG. 10, it can be seen that the apparatus (10) is further provided with a locking bar (70) which has an elongated rectangular configuration and which is dimensioned to be received in a selected one of the track channels (44) joining identical apparatus (10) together in a end-to-end fashion.

As shown in FIG. 10, the locking bar (70) is provided with threaded bores (71) disposed proximate to, but spaced from the ends of the locking bar (70), wherein the bores (71) are dimensioned to receive locking nuts (72) for securing the opposite ends of the locking bar (70) into the abutting ends of two apparatus (10) placed into a end-to-end relationship by use of a special tool (73).

Turning now to FIG. 11 it can be seen that the gap (49) between the spaced track channels (44), (44') is dimensioned to receive securing means (50) for operatively and releasably attaching diverse tools (not shown) to the top of the work bench apparatus (10).

Figure 12:
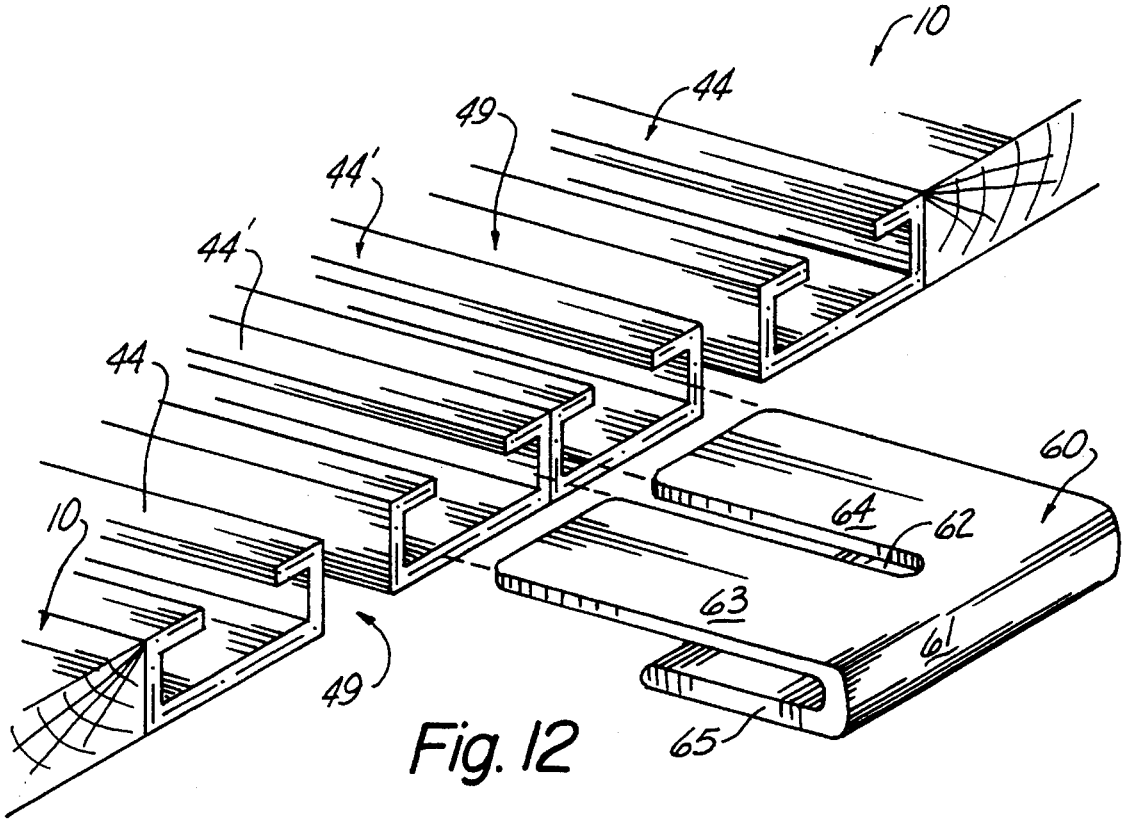
FIG. 12 is an isolated perspective view of the side to side engagement of two identical work bench apparatus.

In addition as can be seen by reference to FIG. 12, the locking clip (60) may be employed to join two identical work bench apparatus (10) together in a side by side engagement; wherein, the locking clip (60) captively engages the outboard track channels (44') on each work bench apparatus (10).

It should also be noted that this invention also encompasses an adjustable height feature which involves the selective removal of one or both of the centrally disposed abutting track channels (45); wherein the height adjustment of the apparatus is related to the width of the track channels (45) that are removed.

In the embodiment of the invention that is depicted in the drawings, the removal of each track lowers the height of the apparatus by 1¼ inches so that the total height adjustment can be as much as 2½ inches.

Having thereby described the subject matter of the present invention, it should be apparent that many substitutions, modifications and variations of the invention are possible in light of the above teachings. It is therefore to be understood that the invention as taught and described herein is only to be limited to the extent of the breadth and scope of the appended claims.

I claim:

1. A collapsible work bench apparatus for use with conventional clamps; hand tools, and power tools wherein the apparatus comprises:

two pairs of support legs pivotally secured to one another proximate their midpoints; wherein, said two pairs of support legs comprise a first outer pair of support legs and a second inner pair of support legs;

a strut assembly comprising: a first pair of outer strut arms pivotally secured on one end to the upper end of the outer pair of support legs; and, a second pair of inner strut arms pivotally secured on one end to the upper end of the inner pair of support legs; and a work support assembly comprising two mirror image table top portions, wherein each table top portion is rigidly secured to the free ends of one of the pairs of strut arms; and, each table top portion having an inboard edge provided with an elongated inboard track channel; and, further having an outboard edge provided with an elongated outboard track channel wherein the outboard and inboard track channels are disposed in the same plane as their respective table top portions.

2. The apparatus as in claim 1, further comprising first means for captively engaging one of the table top portions to the other of the table top portions.

3. The apparatus as in claim 2 further including second means for joining more than one apparatus in an end-to-end relationship with one another.

4. The apparatus as in claim 3; wherein, said first and said second means are the same.

5. The apparatus as in claim 1 further comprising third means for joining more than one apparatus in a side-to-side relationship to one another.

6. The apparatus as in claim 1; wherein, each table top portion includes an enlarged generally rectangular rigid support surface.

7. The apparatus as in claim 6; wherein, said rigid support surface is further provided with shear blocks which operatively engage one of said pair of strut arms.

8. The apparatus as in claim 6; wherein said enlarged generally rectangular rigid support surface is provided with a plurality of spaced apertures.

9. The apparatus as in claim 8, wherein said spaced apertures are aligned in spaced rows.

10. The apparatus as in claim 1; wherein, said inboard track channel comprises a single removable track channel; and, said outboard track channel comprises a pair of spaced track channels.

11. The apparatus as in claim 1; wherein, said apparatus further includes a lock clip for captively engaging said inboard track channels on each table top portion to one another.

12. The apparatus as in claim 1; wherein, said apparatus further includes a locking bar for joining the outboard track channels of more than one apparatus together in an end-to-end relationship.

13. The apparatus as in claim 1; wherein, each pair of support legs are provided with a brace element.

14. The apparatus as in claim 13; wherein, one of the brace elements includes a central body portion having a handle aperture formed therein.

15. The apparatus as in claim 14; wherein, said one of the brace elements is provided with at least one brace arm which is connected at each end to one of the pairs of support legs.

16. The apparatus as in claim 14; wherein, the other of the brace elements comprises a generally flat rectangular brace element.

17. The apparatus as in claim 1; wherein, each of the support legs is provided with a foot member, including a rubberized bearing pad having two distinct angled bearing surfaces.

18. The apparatus as in claim 17; wherein, said angled bearing surfaces are formed to provide non-slip traction.

19. The apparatus as in claim 1; wherein, said apparatus further includes a lock clip for captively engaging the outboard track channels on identical adjacent apparatus to one another.

20. A collapsible work bench apparatus for use with conventional clamps; hand tools, and power tools wherein the apparatus comprises:

two pairs of support legs pivotally secured to one another proximate their midpoints; wherein, said two pairs of support legs comprise a first outer pair of support legs and a second inner pair of support legs;

a strut assembly comprising: a first pair of outer strut arms pivotally secured on one end to the upper end of the outer pair of support legs; and, a second pair of inner strut arms pivotally secured on one end to the upper end of the inner pair of support legs; and a work support assembly comprising two mirror image table top portions, wherein each table top portion is rigidly secured to the free ends of one of the pairs of strut arms and is provided with an apertured top surface having an inboard edge and an outboard edge; wherein both of said edges are provided with an elongated track channel disposed adjacent and parallel to the respective edges and aligned in the same plane as the table top portion.

21. The apparatus as in claim 20; wherein, the inboard edge track channel comprises a single removable track channel.

22. The apparatus as in claim 21; wherein, the outboard edge track channel comprises a pair of spaced track channels.

23. A collapsible work bench apparatus for use with conventional clamps; hand tools, and power tools wherein the apparatus comprises:

two pairs of support legs pivotally secured to one another proximate their midpoints; wherein, said two pairs of support legs comprise a first outer pair of support legs and a second inner pair of support legs;

a strut assembly comprising: a first pair of outer strut arms pivotally secured on one end to the upper end of the outer pair of support legs; and, a second pair of inner strut arms pivotally secured on one end to the upper end of the inner pair of support legs;

a work support assembly comprising two mirror image table top portions, wherein each table top portion is rigidly secured to the free ends of one of the pairs of strut arms; and, each table top portion having an inboard edge provided with an elongated inboard track channel; and, further having an outboard edge provided with an elongated outboard track channel; and, first means for captively engaging one of the table top portions to the other of the table top portions.

24. The apparatus as in claim 23 further including second means for joining more than one apparatus in an end-to-end relationship with one another.

25. The apparatus as in claim 24; wherein, said first and second means are the same.

26. The apparatus as in claim 23 further comprising means for joining more than one apparatus in a side-to-side relationship to one another.

27. The apparatus as in claim 23; wherein, said inboard track channel comprises a single removable track channel; and, said outboard track channel comprises a pair of spaced track channels.

28. The apparatus as in claim 27; wherein, said apparatus includes a lock clip for captively engaging said inboard track channels on each table top portion to one another.

* * * * *